United States Patent [19]

Stewart et al.

[11] Patent Number: 4,629,436

[45] Date of Patent: Dec. 16, 1986

[54] PERSONAL FLOTATION ASSISTANCE DEVICE

[75] Inventors: James F. Stewart, 325 Shore Rd., Greenwich, Conn. 06830; Milton P. Chernack, West Hempstead, N.Y.

[73] Assignee: James F. Stewart, Greenwich, Conn.

[21] Appl. No.: 762,145

[22] Filed: Aug. 2, 1985

[51] Int. Cl.[4] ..... B63C 9/16

[52] U.S. Cl. ..... 441/93; 441/88; 441/122; 222/5; 74/98

[58] Field of Search ..... 441/88, 90, 92, 93, 441/94, 122, 42; 222/5, 83, 83.5; 74/98, 99; 49/70; 114/54

[56] References Cited

U.S. PATENT DOCUMENTS

| | | | |
|---|---|---|---|
| 1,221,852 | 4/1917 | Gerley . | |
| 1,585,695 | 5/1926 | Schroeder | 222/5 |
| 1,611,427 | 12/1926 | Evans . | |
| 2,111,358 | 3/1938 | Crockett . | |
| 2,128,423 | 8/1938 | Manson . | |
| 2,979,740 | 4/1958 | Walker et al. . | |
| 3,042,946 | 7/1962 | Davis et al. | 441/94 |
| 3,070,818 | 1/1963 | Fairchild . | |
| 3,113,327 | 12/1963 | Cook | 441/94 |
| 3,173,162 | 3/1965 | Elder | 441/94 |
| 3,291,068 | 12/1966 | Wiggermann . | |
| 3,490,648 | 1/1970 | Fujimoto . | |
| 3,727,252 | 4/1973 | Bauermeister . | |
| 3,760,442 | 9/1973 | Diforte, Jr. . | |
| 3,775,788 | 12/1973 | Markwitz . | |
| 3,815,783 | 6/1974 | Hirata . | |
| 3,820,179 | 6/1974 | Maertin . | |
| 3,828,381 | 8/1974 | Prager | 441/93 |
| 3,952,355 | 4/1976 | Bardebes . | |

FOREIGN PATENT DOCUMENTS

| | | | |
|---|---|---|---|
| 731584 | 6/1955 | United Kingdom | 441/94 |

*Primary Examiner*—Sherman D. Basinger
*Assistant Examiner*—Paul E. Salmon
*Attorney, Agent, or Firm*—Cohen, Pontani & Lieberman

[57] ABSTRACT

A personal flotation assistance device includes a housing having an open end, a cover pivotally movable from a first position closing the open end and a second position opening that end, a container of pressurized fluid having a frangible membrane, a pin for puncturing the membrane, an expandable envelope disposed in an initially collapsed condition, and a gear assembly connecting the cover and pin. User manipulation of the cover to move the same from its first to its second position causes pin movement both rotationally about its axis and translationally along that axis into membrane puncturing abutment, thereby releasing the pressurized fluid for inflating the envelope to provide the user with flotation assistance. Cover movement to its second from its first position additionally serves to clear the housing open end thus enabling expansion of the inflating envelope outwardly from the housing interior.

32 Claims, 9 Drawing Figures

FIG. 1
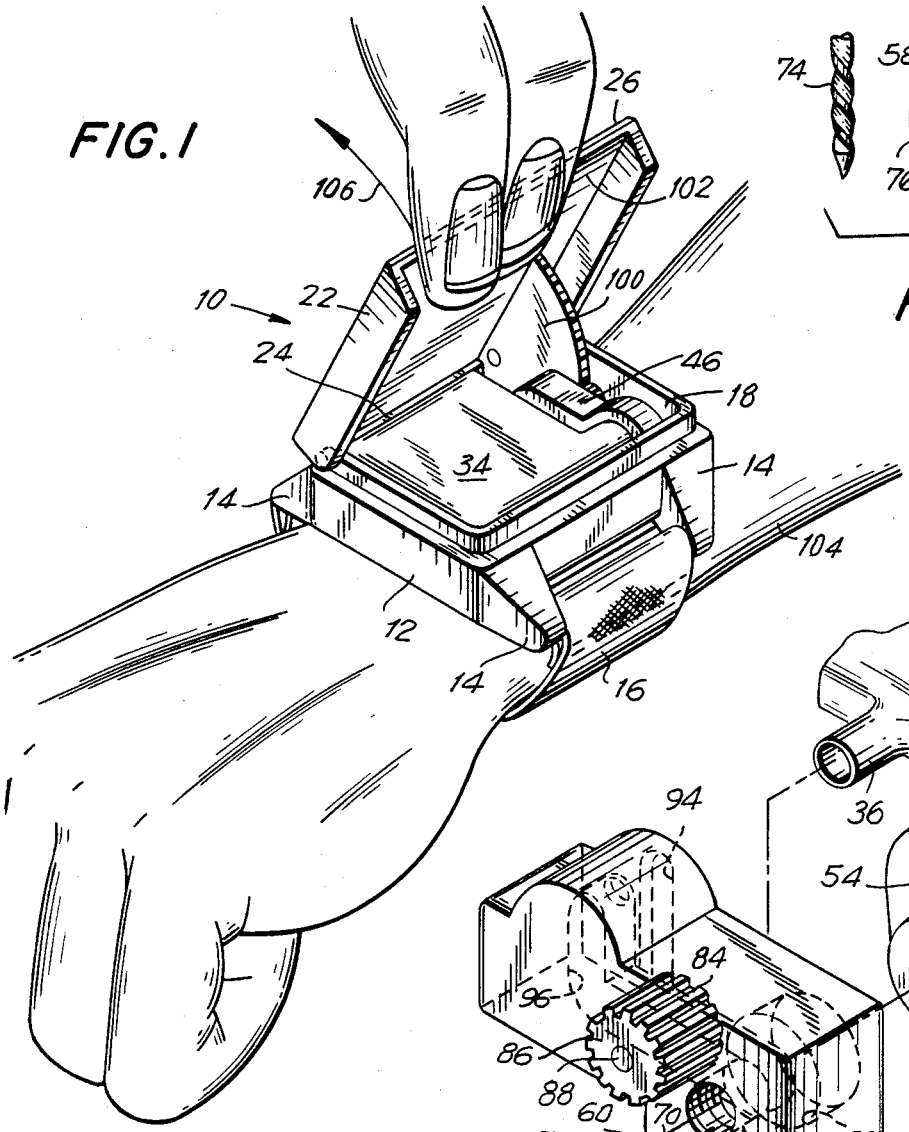
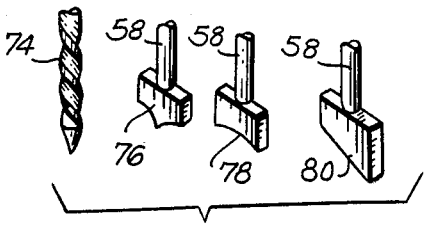
FIG. 9
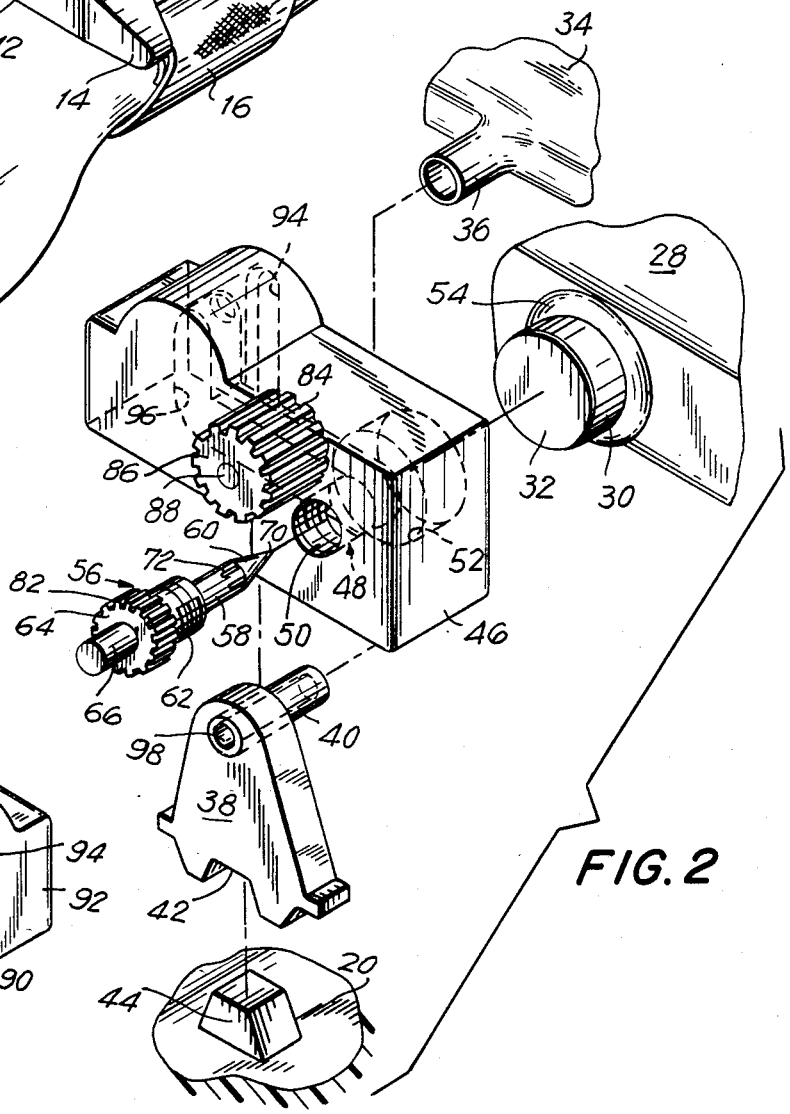
FIG. 2
FIG. 3
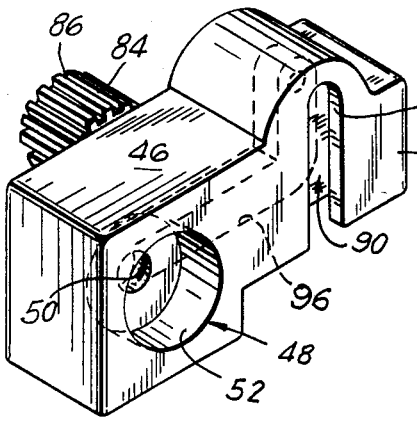

PERSONAL FLOTATION ASSISTANCE DEVICE

BACKGROUND OF THE INVENTION

The present invention generally concerns lifesaving devices for quickly and reliably imparting increased buoyancy sufficient to assist in maintaining a user's body afloat in water during an emergency. The invention more specifically relates to a portable or personal flotation assistance device which requires only a single, readily effected actuating step by the user.

The prior art is replete with devices securable to or about a user's body so that, in a sudden or otherwise unforeseen emergency, sufficient buoyancy in water to help keep the user afloat is available. The standard life jacket, such as that disclosed in U.S. Pat. No. 2,128,423 of Manson, fits about the user's body trunk in the manner of a garment and includes expandable compartments inflated by the pulling of ripcords to open valved pressurized gas cartridges. Although such jackets are standard, if not required, equipment aboard passenger-carrying watercraft (and aboard aircraft commercial aircraft flying over water), they are by their very size, configuration and manner of use inherently uncomfortable and confining to wear and are therefore not often worn by those aboard boats. When an unforeseen emergency does develop, the stowed life jackets may be difficult to locate and, if and when found, require an amount of time and effort to put on which may not be available before the individual finds himself involuntarily cast into the water. The substantial number of unnecessary drownings in boating accidents each year attest to these serious drawbacks.

Similar devices configured to be worn about the waist in the manner of a belt, such as those disclosed in U.S. Pat. Nos. 1,221,852 of Gerley, No. 3,760,442 of DiForte, Jr. and No. 3,952,355 of Bardebes, are also known. These buoyancy aids suffer from deficiencies akin to those associated with standard life jackets and, in addition, may prove difficult for the user to actuate in an emergency by reason of their positioning about the mid or lower body trunk. Moreover, manufacturers' efforts to reduce the time and actions needed to secure such devices about the user's waist by simplifying their clasp or buckling arrangements have resulted in devices that are altogether too easy to release as, for example, inadvertently by a panicing user's arm and body movements during an emergency.

Still other lifesaving or buoyancy assist devices, less in the way of garment-type arrangements but nonetheless intended for securement to the body, are also known. For example, U.S. Pat. Nos. 1,611,427 of Evans and No. 2,111,358 of Crockett each disclose an inflatable sleeve to be worn about the arm as an aid to natation. However, the Evans and Crockett devices, since they must be manually inflated by having the user exhale into one or more internal air chambers thereof, are generally unsatisfactory as lifesaving aids readily available in a sudden emergency; they are far better suited for use by an inexperienced swimmer seeking to improve upon his or her skills. Similar flotation sleeves are disclosed in U.S. Pat. Nos. 3,727,252 of Bauermeister and No. 3,820,179 of Maertin.

There is shown in U.S. Pat. No. 3,070,818 of Fairchild a lifesaving device worn about the wrist like a watch, and of similar size, containing an inflatable bag in one chamber and a volume of compressed gas in another. When the cover of the device is struck by a sharp downward blow a pointed valve is driven through a wall separating the two chambers to release the gas and fill the bag and thereby provide buoyancy to the user. While the small size of the Fairchild device may reduce one's reluctance to keep the unit secured to the body, the ability of the user to strike with sufficient force and accuracy the required sharp downward activating blow in a sudden emergency, and perhaps while in the water trying to remain afloat until the bag is fully inflated, is unclear. Should the pointed valve member be driven only partially through its supporting plug and into the gas chamber, the outward flow of gas into and inflation of the bag would be seriously impeded, resulting in a potentially life-threatening failure of the Fairchild device for its intended and expected purpose.

Thus, buoyancy assisting or lifesaving devices heretofore known suffer from a variety of serious deficiencies including the need for manual inflation, unreliability or difficulty in actuation and use, discomfort when worn for extended periods, undue complexity for securement to the body, and physical obtrusiveness which interferes with other activities or which negatively impacts upon the appearance of the user.

OBJECTS OF THE INVENTION

It is therefore broadly the desideratum of the present invention to provide a portable or personal lifesaving device that overcomes the shortcomings and deficiencies of the prior art. Specifically, it is an object of the invention to provide a buoyancy assisting lifesaving device that is compact, unobtrusive and which may be secured to a user's body for extended periods without discomfort, thereby rendering the device useful for imparting increased buoyancy for emergency use in situations beyond those merely associated with watercraft and the like.

It is another object of the present invention to provide such a device which requires only a single, readily effected actuating step or motion by the user to provide the desired buoyancy assistance.

It is a further object of the invention to provide such a device in which the actuating step is sufficiently simple and straightforward to be readily performable by a user having insufficient time or presence of mind to carefully consider and perform the actuating step.

It is still another object of the invention to provide such a device in which the single actuating step reliably effects the complete and unimpeded release of a stored pressurized fluid to rapidly inflate an initially collapsed envelope carried in the device.

Yet another object of the invention is to provide such a device having replaceable elements to ensure its practical reusability.

An additional object of the invention is to provide such a device which is relatively low in cost and which may be economically manufactured utilizing well known techniques and readily available materials.

SUMMARY OF THE INVENTION

The foregoing and other objects, features and advantages of the invention are realized in a buoyancy assisting lifesaving device having a housing securable about the user's arm in the manner of a wristwatch and having an open end. Disposed within the housing are a cartridge containing a supply of pressurized fluid, an initially collapsed envelope and an appropriately configured pin mounted for movement relative to the cartridge for puncturing the same and thereby effecting release of the pressurized fluid therein contained. A cover is mounted for movement on and relative to the housing between a first position in which the cover overlies and closes the open end of the housing and a second position in which the cover is withdrawn or disposed remote from or clear of the open end. In the presently preferred form of the invention, the cover is hinged to the housing for pivotal movement between its first and second positions. A gear assembly directly connects the cover to the pin so that, as the cover is moved from its first to its second position, the pin moves relative to the pressurized fluid cartridge to puncture a predetermined wall portion thereof. In a preferred form of the invention, the pin is caused to move both translationally toward the cartridge along the pin axis and rotatably about that axis to, in effect, drill through the predetermined cartridge wall portion. Actuating movement of the cover from its first to its second position thus both directly drives the pin into wall-puncturing abutment with the pressurized fluid cartridge, by which the fluid is released and the expandable envelope inflated, and clears or opens the housing open end through which the internally-disposed envelope expands outwardly from the housing for imparting increased buoyancy to the user.

Further objects, features and advantages of the present invention will be more fully appreciated by reference to the following detailed description of a presently preferred, but nonetheless illustrative, embodiment in accordance with the invention when taken in conjunction with the accompanying drawing.

BRIEF DESCRIPTION OF THE DRAWING

In the drawing, wherein similar reference characters denote similar elements throughout the several views:

FIG. 1 is an elevated perspective view of a portable lifesaving device constructed in accordance with the invention and shown strapped about the wrist of a user;

FIG. 2 is an exploded view of an interior portion of the lifesaving device of FIG. 1 depicting the interrelation of certain operating elements thereof;

FIG. 3 is an elevated perspective view of the channel block of the inventive device of FIG. 1;

FIG. 9 is an elevated perspective view, partly broken away, of several alternative fluid container piercing pin ends for use in connection with the invention.

DETAILED DESCRIPTION OF THE PREFERRED EMBODIMENT

Figure 4:
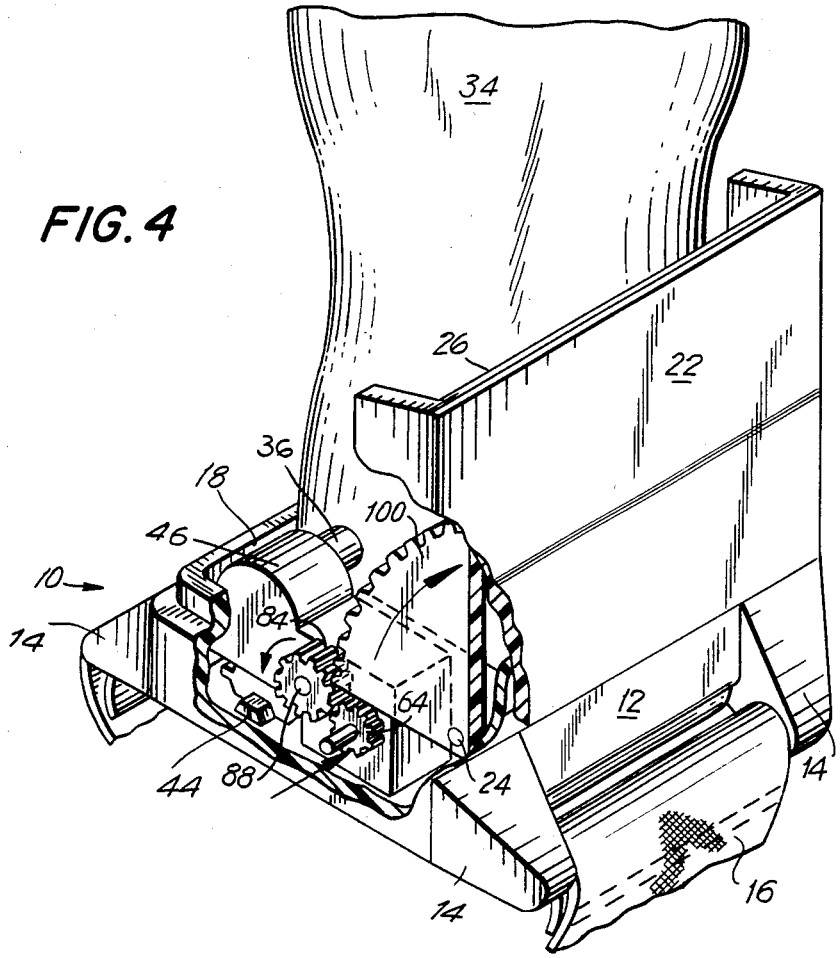
FIG. 4 is an elevated perspective view, with the cover and housing partly broken away, of the inventive device of FIG. 1.

Turning now to the drawing, there is shown in FIG. 1 a personal lifesaving device according to the invention for providing flotation assistance to a user wearing the device or to whom it is otherwise secured. It should at the outset be noted that the preferred embodiment herein described and illustrated is primarily intended as an aid to flotation as, for example, in sudden and unforeseen circumstances and not as a substitute for approved emergency flotation apparatus, such as the standard life jacket, which will provide long term water buoyancy in severe or unusually adverse conditions. Thus, although the disclosed construction will likely find its greatest application and utility when employed by swimmers or boaters in relatively calm waters, those skilled in the art will nonetheless recognize and appreciate that the invention is readily adaptable for assuring the increased flotation assistance that may be required for extended term buoyancy or for maintaining the user afloat in heavy seas or harsh weather conditions.

The personal lifesaving or flotation assistance device herein illustrated and described, generally designated by the reference numeral 10, is perhaps best seen in FIG. 1 to be constructed in a housing or casing 12 having the form and general dimensions of a wristwatch. As such, housing 12 includes pairs of opposed arms 14 to which a strap or band 16 is secured as by a shaft 17 (FIG. 5) extending between each pair of opposed arms 14. Strap 16 may incorporate a clasp or other releasable securement device of any conventional or desired form. The device 10 is thus securable about the user's wrist or other portion of the arm, or alternatively about another body limb; other arrangements and positions for securement of device 10 to the user's person will be readily apparent to those skilled in the art and are within the scope and contemplatation of the invention. In any event, as will hereinafter become clear, it is preferred that the inventive flotation assistance device 10 be readily and releasably securable to some portion of the user's body so as to render it quickly and easily, yet unobtrusively, available in the event of a sudden need for flotation assistance.

Housing 12 may be formed as a single, unitary body having an open end 18 shown in the drawings and provided in the disclosed embodiment at the top of device 10—i.e. on the side of the casing opposite the user's skin surface against which the flotation device rests. It is however preferred that housing 12 incorporate a removable bottom or base plate 20 to render device 10 reusable by replacement of certain operating elements thereof as will hereinafter become apparent. Bottom plate 20 may be mounted to the remainder of housing 12 by any suitable structure (not shown) such, for example, as screws or interlocking releasable couplings or the like; the securement of device 10 against the user's skin will also assist in preventing unintended disengagement of plate 20 from the remainder of housing 12.

Figure 5:
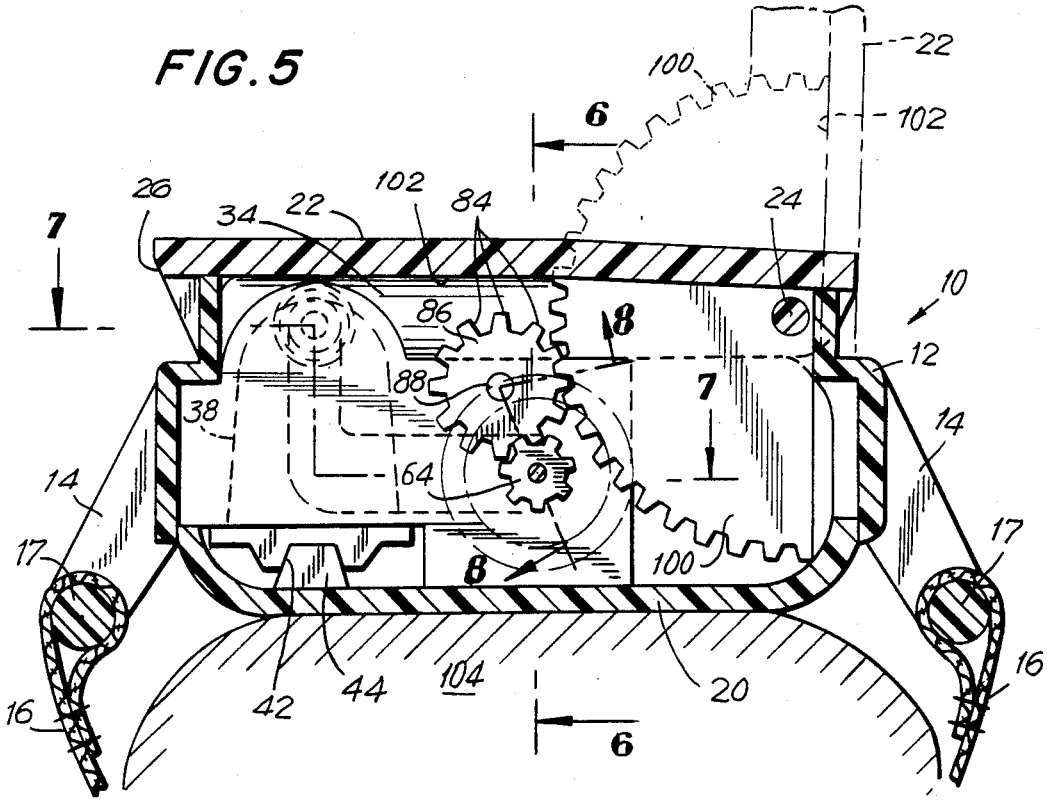
FIG. 5 is an end sectional view of the inventive device of FIG. 1.

Referring now to FIGS. 1, 4 and 5, a cover 22 is pivotally hinged to housing 12 along the axis defined by a pivot pin or shaft 24. Cover 22 is thus hinged and mounted for arcuate pivotal movement between a first position (FIG. 5) in which the cover overlies and thereby closes or fully blocks the open end 18 of the housing, and a second position (FIG. 4) in which the cover is disposed clear of or remote from housing open end 18 so that the housing is at least substantially open at that end. Put another way, cover 22 is pivotally rotatable from its first position overlying or closing the housing open end 18 to a second position which, in the embodiment herein shown and described, is attained by cover movement through an arc of approximately 90°. An appropriate stopper mechanism (not shown) may be provided for preventing further rotation of the cover beyond its illustrated second position or, as a matter of design choice, the cover may be permitted to further pivot beyond its illustrated upright orientation. It is also within the contemplation of the invention that the so-called second position of cover 22 may alternatively be attained or defined by rotation through an arc of less than 90° from its first position, so long as any such reduction in movability of the cover does not interfere with the operation of device 10 as will hereafter be more readily understood. The free edge 26 of cover 22 most remote from shaft 24 may advantageously include means for facilitated manipulative grasping thereof by the user for actuation and use of lifesaving device 10; in the disclosed embodiment cover 22 is dimensioned so that edge 26 forms a lip which overhangs and extends beyond the respective housing wall (FIG. 5).

A tank or reservoir 28 for containing a supply of pressurized fluid is disposed in housing 12. Tank 28 includes an outwardly projecting neck 30 having a frangible membrane or wall portion 32 proximate the outermost end of the neck and closing the tank against the escape of pressurized fluid contained therwithin. Membrane 32 may be formed of any material impervious to the fluid contained in tank 28 and may, for purposes of illustration, be formed of an aluminum alloy or other metallic material in sheet form. It is presently contemplated in respect of device 10 that tank 28 contain approximately one cubic inch of compressed fluid at a pressure sufficient to inflate the expandable envelope hereafter described to an extent and at a rate appropriate to the intended use of the flotation device. In the currently preferred embodiment, the contained fluid is a liquified or a compressed gas such, for example, as carbon dioxide or butane. As also shown, tank 28 may be implemented as a pressurized gas cartridge removably disposed in housing 12 to render the same readily interchangeable and replaceable through the underside of the housing when bottom plate 20 is detached therefrom.

Also removably disposed within housing 12 is an envelope 34 initially arranged in folded or otherwise collapsed condition (FIGS. 1 and 6) but inflatable by the pressurized fluid contained in tank 28 to an expanded condition (FIG. 4) in which the envelope projects outwardly from housing 12 through its open end 18 as will hereafter be described. Envelope 34 may, by way of example, be formed of a polyethylene copolymer or of an ethylene with vinyl acetate reinforcement although any constructural material having sufficiently high strength and impact resistance for the intended use may be employed. In the disclosed embodiment, it is contemplated that envelope 34 have a fully inflated volume of between 300 and 600 cubic inches and may, by way of example, be implemented as a generally tubular envelope having a diameter of approximately 6 to 7 inches and approximately 12 to 15 inches in length.

Although not required, it is preferred that envelope 34 be constructed of non-elastic material and that, when inflated by the fluid contained in tank 28, the net interior pressure of the envelope is substantially zero. A non-expandable envelope, as contrasted to the expandable balloon commonly employed in prior art flotation devices, is particularly advantageous in that less fluid or gas pressure is required to inflate a non-elastic envelope; in addition, such an envelope is both less readily punctured and, should a leak develop, the rate of fluid loss through the puncture or opening is minimized by reason of the substantially zero net pressure within the envelope. Thus, it should be understood that the use herein of the term "expandable" with respect to the envelope is primarily intended to denote non-elastic expansion or inflation thereof, even though in a currently non-preferred form of the invention an elastically expandable envelope may be employed. Put another way, whether an elastic or a plastic envelope is used, it is preferred that it be so inflated that the net internal pressure is substantially zero.

Envelope 34 is secured, as at a radially constricted neck 36, to an envelope mounting member 38. Member 38 integrally carries a hollow feed tube 40 sized for snug-fitting engagement within envelope neck 36. The relative dimensioning of envelope neck 36 and feed tube 40 should be such that a fluid-tight and non-releasable engagement be effected therebetween; in the alternative, or in addition, the non-releasable interengagement of the neck and tube may be assured by application of a suitable adhesive material therebetween or of one or more appropriately configured clamping members thereto.

As further seen in FIG. 2, envelope mounting member 38 of the disclosed device 10 is in the form of a thin, generally triangularly-shaped box-like structure having a notch or keyway 42 defined in its bottom surface remote from tube 40. Keyway 42 is configured and located for cooperative receipt of an upstanding boss or key 44 which protrudes from the interior surface of housing bottom plate 20 to facilitate proper positioning of member 38 and to secure the same against movement in the assembled flotation device 10.

Referring particularly now to FIGS. 2 and 3, portable flotation device 10 further includes in housing 12 an elongated channel block or body 46. In a preferred, reusable form of device 10 the channel block 46 is securely fixed nonremovably within the housing interior; i.e. block 46 is not one of the components that must be replaced to reready the device 10 after use. A throughbore generally designated 48 is transversely defined in block 46 and has a threaded portion 50 at one end and a contiguous radially enlarged portion 52 at its other end. Enlarged portion 52 is sized to generally conform in substantially close fitting engagement to the outer diameter of fluid container neck 30. A substantially fluid-tight seal between the enlarged portion 52 of throughbore 48 and container neck 30 received therein may be assured by the addition of an O-ring 54 or like sealing member disposed about neck 30 at its juncture with the body of fluid container 28.

Figure 6:
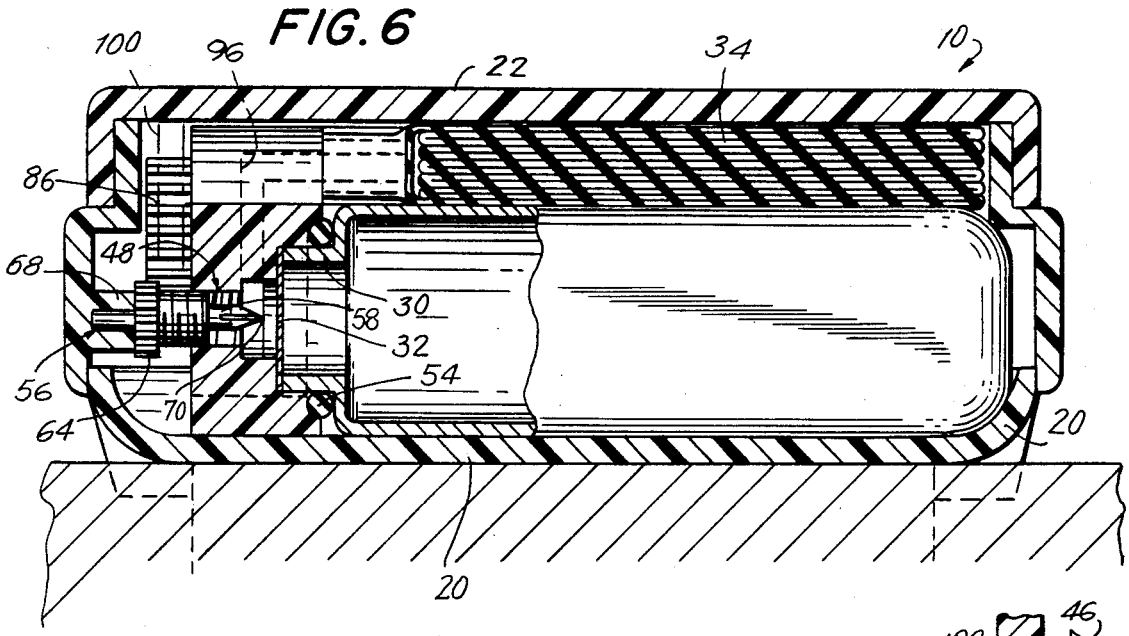
FIG. 6 is a side view taken along the lines 6—6 in FIG. 5.
Figure 8:
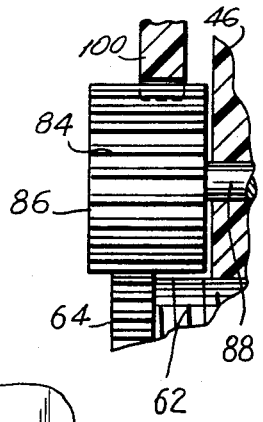
FIG. 8 is a detail of a portion of the gear mechanism of the inventive device of FIG. 1 taken along the lines 8—8 in FIG. 5.
Figure 7:
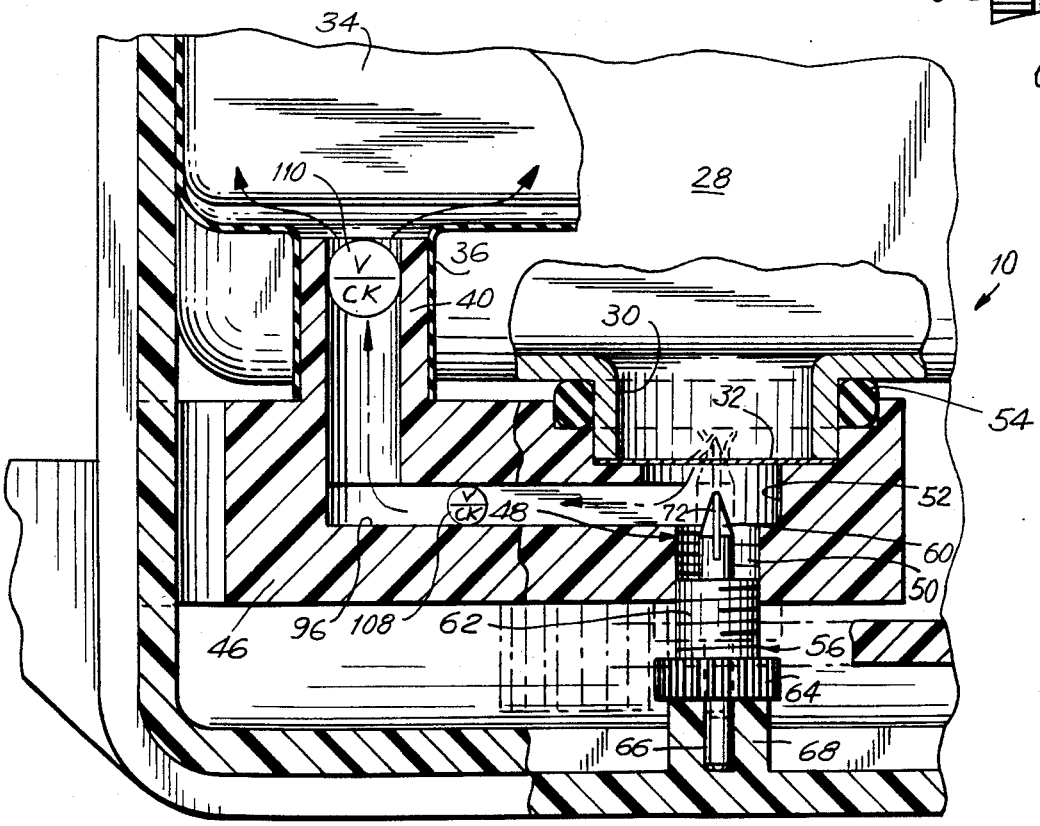
FIG. 7 is a plan view taken along the lines 7—7 in FIG. 5.

The radially smaller, threaded portion 50 of throughbore 48 receives an integral piercing pin member or assembly generally designated 56 and formed on a shaft 58. Assembly 56 includes, at its head end, a membrane piercing pin 60 and, moving rearwardly along shaft 58, a threaded portion 62, a pin gear 64 and, at is rearmost extreme, a shank 66. As seen in FIGS. 6 and 7, shank 66 is journaled for supported rotation in an aperture defined in a boss 68 which inwardly projects from a sidewall of housing 12.

In the embodiment of the portable flotation device 10 illustrated in FIGS. 1 to 8, the piercing pin 60 disposed at the head end of assembly 56 is formed as a conical tapering of shaft 58 to a sharpened end point 70. Pin 60 further includes a plurality of circumferentially-spaced axial grooves 72 which may, for purposes that will become clear as this description proceeds, incorporate sharpened groove-defining edges. It is additionally within the scope and contemplation of the invention that the so-called piercing pin 60 assume a myriad of alternative forms such, by way of example, as those illustrated in FIG. 9. Thus, and referring specifically to FIG. 9, the head end of piercing pin assembly 56 may be configured as a conventional drill bit 74, or as one of the illustrated milling cutter heads 76, 78, 80 heretofore known to those skilled in the art. Numerous additional possible forms for the head or membrane piercing end of pin assembly 56 will become apparent once this disclosure of the invention is known.

Threaded portion 62 of the illustrated pin assembly 56 is configured radially larger than shaft 58; portion 62, and the threads therein defined, are dimensioned and configured for cooperative rotated engagement with the threaded portion 50 of throughbore 48 so that, as assembly 56 axially turns in the clockwise sense, assembly 56 threads into throughbore portion 50 and axially translates forwardly into channel block 46 to carry pin 60 into piercing abutment with fluid container membrane 32. Counterclockwise rotation of pin assembly 56 correspondingly carries the assembly axiallly rearward along throughbore 48.

Pin gear 64, which is disposed on shaft 58 contiguously rearward of threaded portion 62, is seen in FIG. 2 to be configured radially larger than portion 62. The regularly spaced teeth 82 on gear 64 are sized and spaced for mutual meshing engagement with the teeth 84 of an idling gear 86 disposed immediately adjacent pin gear 64. Idling gear 86 is journaled for freewheeling rotation on a shaft 88 which depends from channel block 46, and the diameter of idling gear 86 is larger than that of pin gear 64. Thus, counterclockwise rotation of idling gear 86 drives pin gear 64—and with it the entirety of integral pin assembly 56—through a clockwise rotation by which piercing pin 60 is simultaneously both rotated about it axis and, by virtue of the cooperative interengagement of pin assembly threaded portion 62 with throughbore threaded portion 50, translated along its axis toward envelope membrane 32. Moreover, for any given rotation of idling gear 86, pin gear 64 is driven through a greater rotational arc due to the larger diameter of idling gear 86 with respect to pin gear 64.

Channel block 46 additionally includes a hollow or recess 90 defined proximate the end of block 46 opposite that carrying throughbore 48 and substantially parallel and adjacent the face or wall 92 of block 46 opposite that from which idling gear shaft 88 depends. Recess 90 communicates with face 92 through an elongated substantially U-shaped slot 94 as best seen in FIG. 3. Recess 90 and slot 94 are configured and sized for receiving envelope mounting member 38 and its integral feed tube 40, respectively, by free sliding movement of the body of member 38 into and along recess 90. Thus, U-shaped slot 94 acts in the manner of a keyway for feed tube 40 as envelope mounting member 38 is inserted into and moved upwardly to its fully seated position within block recess 90 so that, in the assembled condition of flotation device 10, member 38—and with it envelope 34—are secured by and between channel block 46 and housing bottom plate 20 against dislodgement or other displacing movement.

A passageway or conduit 96 defined in channel block 46 extends longitudinally therewithin between throughbore 48 and recess 90. More particularly, passageway 96 includes an inlet at its juncture with throughbore 48 and an outlet at its juncture with recess 90; the outlet is disposed immediately adjacent the open end 98 of feed tube 40 with envelope mounting member fully inserted and seated within channel block recess 90. Passageway 96 thereby defines a conduit or channel for receiving at its inlet fluid released from storage tank 28 and for communicating the fluid to and through its outlet into feed tube 40 and attached inflatable envelope 34.

Cover member 22 carries a segment or quadrant gear 100 fixed to or otherwise depending from its inner face or surface 102. Segment gear 100 has a radius larger than, and preferably significantly larger than, the radius of idling gear 86 with which, by reason of its predetermined placement, it operatively meshes. Thus, as can perhaps best be understood by reference to FIGS. 4 and 5, movement of cover 22 from its first (closed) to its second (opened) positions causes an effective clockwise rotation of segment gear 100, which is transmitted to and drives idling gear 86 through an increased-arc counterclockwise rotation, which in turn drives pin gear 64 through a further increased clockwise rotational arc. Although it is preferred that the teeth of segment gear 100 remain in meshing engagement with the teeth 84 of idling gear 86 throughout the entire range of cover movement from its first to its second positions (seen in full and broken line depictions, respectively, in FIG. 5), it should be apparent that disengagement of the segment and idling gear teeth may occur proximate the second position of cover 22 as the cover is moved there from its first, closed position without defeating the intent and advantageous operation of the invention.

To assemble the disclosed portable flotation device 10 during its initial manufacture, housing 12 is prepared with cover 22 pivotally secured to the housing and disposed in its first position and with base plate 20 uncoupled and removed from engagement with the remainder of housing 12. Shank 66 of pin assembly 56 is inserted into the aperture defined in housing boss 68, and channel block 46 is secured to housing 12 in any convenient or desired manner. By way of example, the end wall of block 46 proximate the outlet end of fluid passageway 96 may be screwed or cemented or otherwise firmly secured to the adjacent sidewall of housing 12 (FIG. 5). Envelope 34 is then placed in the housing by slideably inserting its attached mounting member 38 into channel block recess 90 until member 38 seats firmly therewithin. A container or tank 28 of pressurized fluid is next placed in housing 12 by inserting its neck 30 into the enlarged portion 52 of throughbore 48 to seat tank 28 against movement within the housing. Finally, base plate 20 is secured to the remainder of housing 12, and the portable flotation device 10 is then ready to be strapped to or otherwise secured on the user's wrist or other body portion.

To reprepare the device 10 after use, base plate 20 is detached from housing 12 and the spent fluid tank 28 and inflated envelope 34 are removed and discarded. A new tank 28 and collapsed or folded envelope 34, with its accompanying member 38, are then inserted into housing 12, as above described, and base plate 20 replaced on the remainder of the housing. The portable device 10 is thus again ready for emergency operation and use as needed.

In use, the personal flotation assistance device 10 is secured to any convenient portion of the user's body; in the disclosed embodiment illustrated herein, it is strapped, by way of bands 16, about the wrist in the manner of a watch. The unusually small size and low profile of device 10 permit the unit to be worn unobtrusively, and without interference with most any physical activity, for extended periods. As a consequence, a user heading for a day of swimming at the beach, or at a pool, or for a day of boating or other water-related activities, may advantageously secure the inventive portable flotation device to his or her wrist early in the day and wear it continuously until returning home. Should a sudden emergency or unforeseen circumstance requiring flotation assistance arise, the unit is immediately available, secured to the wrist, for ready actuation as will now be described.

The single-step method of such actuation is so simple that even a very young child can understand and remember and carry out the operation. In the cross-sectional side view of FIG. 5, the flotation device 10 is shown in its initial, unactuated, "ready" condition strapped to the user's wrist 104. When flotation assistance is deemed necessary, the user need merely grasp cover 22 at its free edge 26 and, applying the upwardly-directed manipulative force indicated by arrow 106 in FIG. 1, lift the cover to move it from its first to its second position. The entire mechanical operation required of the user to activate the portable flotation device 10 is then complete.

Movement of cover 22 from its first (FIG. 5 solid line) position to its second (FIG. 4; FIG. 5 broken line) position carries integral segment gear 100 fixed thereto through a partial clockwise rotation. Since segment gear 100 is mutually coupled to relatively smaller idling gear 86, the latter is driven by the segment gear rotation through a correspondingly larger counterclockwise rotation. The coupled interengagement of idling gear 86 and relatively smaller pin gear 64 causes the latter to be likewise driven through a clockwise rotation correspondingly greater than that seen by idling gear 86. Thus, in the disclosed device 10 an effective segment gear rotation of approximately one-quarter turn drives, via idling gear 86, the pin gear 64 through as much as several complete rotations.

As the pin gear rotates, it carries with it the entire integral pin assembly 56. With such rotation, threaded portion 62 of assembly 56, in conjunction with the throughbore threads 50 with which it is in meshing engagement, causes assembly 56 to axially translate further into channel block 46, thereby carrying the sharpened end 70 of piercing pin 60 toward and into abutment with frangible fluid container membrane 32. The sharpened end 70 of assembly 56 is thereby caused to pierce membrane 32, releasing the pressurized fluid contained in tank 28.

Referring now to FIG. 7, the pressurized fluid exiting tank 28 through the punctured opening in membrane 32 enters throughbore 48 and is communicated through passageway 96 into initially collapsed or folded envelope 34. The envelope is thereby caused to unfold and inflate as it fills with the pressurized fluid from tank 28, expanding outwardly from housing 12 through its end 18 which has been opened by the user's actuating manipulation of cover 22 from its first to its second position. The inflated envelope 34, projecting outwardly from housing 12 but still secured thereto by its securement to mounting member 38 captively seated within the confines of channel block recess 90, provides buoyancy and thus flotation assistance to the user. It is presently preferred that the choice of fluid and the pressure under which the fluid is stored in tank 28 be selected so that envelope 34 sufficiently inflates to provide adequate floation assistance to the user within an interval of between one-half and five seconds.

Device 10 may additionally incorporate one or more conventional one-way or check valves (not shown) located between fluid container 28 and envelope 34 —and preferably in at least one of envelope neck 36, feed tube 40 and channel block passageway 96. The inclusion of such valve(s), such for example those diagramatically shown and designated 108, 110 in FIG. 7, will prevent slow leakage of fluid from inflated envelope 34 in the event that the interengagement of the various fluid communicating elements of device 10 provides less than fully adequate seals.

It should now be apparent that a piercing pin 60 which merely tapers to a sharpened end point 70 is, of all possible alternative pin arrangements, the least efficient. Actuation of flotation device 10 causes the piercing pin assembly 56 both to rotate about its axis and to translate along that axis into abutment with the fluid container membrane 32. Thus, rather than merely piercing the membrane by punching the same with its sharpened point, as in prior art devices, assembly 56 in effect drills into membrane 32 and thereby punctures the membrane in an unusually efficient and effective manner requiring a minimum of translational force. As a consequence, the alternate piercing pin assembly heads the latter three of which are of non-circular cross-sectional configuration simple pointed end, and numerous other piercing head ends appropriate for use in the inventive flotation device will readily suggest themselves to those skilled in the art.

Another particularly advantageous feature of the invention is the direct transmittal of the actuating force implemented by the user to pierce membrane 32 and thereby effect inflation of envelope 34. The user-effected movement of cover 22 from its first to its second position, which simultaneously or concurrently opens or clears the housing open end 18 to enable outward expansion of the envelope, directly drives—through interengaged rotation of segment gear 100, idling gear 86 and pin gear 64—the piercing pin 60 into membrane puncturing abutment with fluid container 28. There is no second or intervening user or mechanical step or operation required and, by reason of the mechanical simplicity of the device, actuation in an emergency where flotation assistance is suddenly required is quickly and reliably accomplished.

Yet another advantageous feature of the invention is the dual role performed by cover 22. The cover provides the means by which user actuation of the portable flotation assistance device is effected by simple manipulation to carry the cover from its first to its second position. In addition, that user-effected actuating cover manipulation concurrently clears the open end 18 of housing 12 to permit expansion of the inflating envelope 34 outwardly from the housing interior through the now open end 18. The dual functionality of cover 22 further increases the unusual ease of use of device 10, since the user is required to perform but a single simple manipulation, as well as the operative reliability of the device; by merely opening cover 22 the device is automatically actuated to release the stored pressurized fluid, the housing is opened to permit outward expansion of the inflating envelope, and all mechanical operations are directly coupled to and driven by the cover movement from its first to its second position.

From the foregoing description it should be readily appreciated that the disclosed portable or personal flotation assistance device 10 constitutes a highly reliable, yet easily actuated apparatus that may be conveniently and unobtrusively worn for extended periods and employed in situations where conventional lifesaving equipment may be unavailable or impractical. While preferred structural features have been illustrated, it should be quickly apparent that many and various departures therefrom are possible. Thus, housing opening 18, through which the inflating envelope outwardly expands, can alternatively extend across only a portion of the top of the housing or, still further, can alternatively be defined in a side or end wall of housing 12; in these cases cover 22 would be modified to overlie in its first position the new location of the housing opening.

It is also within the scope and contemplation of the invention that the device incorporate alternative arrangements for cover movability from its first to its second positions. For example, in lieu of cover 22 pivoting about shaft 24, the cover could slide along its first position plane to a transversely displaced second position, or could be arranged on housing 12 so that the required actuating motion pulls the cover completely away from and free of the housing, in, for example, the manner of a soft drink can pull tab. Such alternate cover arrangements would of course require modified actuating gearing—as, for example, by substitution of a flat, elongated toothed gear in place of arcuate segment gear 100—or a wire secured between the cover and idling gear 86 could be employed to directly transmit the cover motion to the internal gearing arrangement by which the piercing pin is rotatably and translationally carried into membrane-puncturing abutment with the fluid container.

Envelope 28 may additionally be provided with a separate mouthpiece and integral one-way valve. Then, should a puncture or leak develop in the envelope during use of the device, the user can at least partially reinflate the envelope by directly blowing into this second inlet.

In other respects, as well as those just noted, a latitute of modification, change and substitution is intended in the foregoing disclosure and in some instances some features of the invention will be employed with a corresponding use of other features. Accordingly, it is both intented and appropriate that the appended claims be construed broadly and in a manner consistent with the spirit and scope of the invention.

What is claimed is:

1. A portable lifesaving device securable to a user's body for providing flotation assistance to the body, comprising:

a housing securable to the body and having an open end;

a cover on said housing adapted for user-effected movement relative thereto between a first position closing said open end and a second position in which said housing end is substantially open;

reservoir means in said housing for containing a supply of pressurized fluid;

pin means in said housing;

gear means operable by said movement of the cover from said first to said second position for moving relatively together said pin means and said reservoir means to cause said pin means to puncture said reservoir means and thereby release the pressurized fluid contained therein;

inflatable envelope means in said housing in an initially collapsed condition;

said pin means being disposed exteriorly of said inflatable envelope means; and passage means between said reservoir means and said envelope means for communicating the pressurized fluid therebetween so that, when the reservoir means is punctured by said pin means, the pressurized fluid released from the reservoir means is communicated to and inflates said envelope means, causing the initially collapsed envelope means to expand outwardly through said open housing end for providing flotation assistance to the user's body to which said housing is secured.

2. A portable lifesaving device in accordance with claim 1, wherein said gear means is operable by said movement of the cover from its first to its second position to cause relative movement of said pin means and reservoir means translationally toward one another along an axis and concurrently rotatably about said axis.

3. A portable lifesaving device in accordance with claim 2, wherein said reservoir means is secured against movement in said housing, and said pin means is driven by said movement of the cover from said first to said second position concurrently through both axial translation and axial rotation into wall-puncturing abutment with said reservoir means.

4. A portable lifesaving device in accordance with claim 2, wherein said pin means comprises a shaft connected proximate one end to said gear means and carrying at its opposite end drill means for puncturing said reservoir means.

5. A portable lifesaving device in accordance with claim 4, wherein said drill means comprises a cutting portion having at least a sharpened edge for puncturing said reservoir means.

6. A portable lifesaving device in accordance with claim 5, wherein said cutting portion is radially larger than at least an adjacent portion of said shaft.

7. A portable lifesaving device in accordance with claim 1, wherein said cover is hinged to said housing for pivotal movement relative thereto so that the cover in said first position closes by overlying the housing open end and in said second position is pivotted outwardly to a position substantially remote from the housing open end to enable expansion of said envelope means outwardly from the housing interior.

8. A portable lifesaving device in accordance with claim 1, wherein said envelope means is disposed in said housing adjacent the housing open end so that, when the cover is moved from its first to its second position to open the housing end and cause puncturing of said reservoir means through operation of the gear means, the envelope means inflating with the pressurized fluid is readily expandable outwardly of the housing through said open end thereof.

9. A portable lifesaving device in accordance with claim 1, wherein said envelope means comprises a non-elastic envelope stored in said housing in an initially folded condition and which, when inflatingly unfolded by receipt of pressurized fluid filling the envelope from said punctured reservoir means expands outwardly from the housing through said open end thereof to define a buoyant envelope in which the fluid is contained at substantially zero pressure.

10. A portable lifesaving device in accordance with claim 1, further comprising one-way valve means in one of said passage means and said envelope means for preventing escape of pressurized fluid communicated from said reservoir means to said envelope means.

11. A portable lifesaving device in accordance with claim 1, wherein said reservoir means includes a frangible wall portion puncturable by said pin means when the pin means is relatively moved into abutment therewith.

12. A portable lifesaving device in accordance with claim 1, wherein said housing is securable to a user's limb in the manner of a wristwatch.

13. A portable lifesaving device in accordance with claim 1, wherein said envelope means in its fully inflated condition has an internal volume in the range of approximately 300 to 600 cubic inches.

14. A portable lifesaving device in accordance with claim 1, wherein at least a portion of said passage means is defined in a member integrally secured to said envelope means.

15. A portable lifesaving device in accordance with claim 1, futher comprising fixed means on said cover for engagement with said gear means to operate said gear means as the cover is moved between its first and second positions.

16. A portable lifesaving device in accordance with claim 15, wherein said fixed means comprises segment gear means on said cover.

17. A portable lifesaving device in accordance with claim 16, wherein said segment gear means comprises a segment gear integrally fixed to said cover.

18. A portable lifesaving device in accordance with claim 17, wherein said segment gear is fixed to said cover so as to be disposed in meshing engagement with said gear means in the first position of the cover and so that, as the cover is moved to said second position, the segment gear continues to engage and operate said gear means along at least a predetermined portion of said cover movement from said first to said second position of the cover.

19. A portable flotation assistance device securable to a user's body, comprising:

a housing securable to the body and having an opening;

reservoir means in said housing for containing a supply of pressurized fluid;

pin means mounted in said housing for movement relative to said reservoir means into wall-puncturing abutment therewith;

envelope means communicating with said reservoir means and disposed in initially collapsed condition in said housing, said envelope means being inflatable by pressurized fluid released from the reservoir means when punctured by said relatively movable pin means so that the envelope means expands outwardly from the housing through its opening to define a buoyant envelope secured to the user's body;

said pin means being disposed exteriorly of said envelope means; and dual function means normally closing the housing opening and operable for concurrently effecting the puncturing of said reservoir means by relatively driving said pin means and reservoir means into wall-puncturing abutment to release the pressurized fluid for inflating said envelope means, and opening the housing opening to permit expansion of the inflating envelope means outwardly from the housing interior;

said dual function means comprising a cover mounted to the housing for relative actuating movement between a first position closing the housing opening and a second position clear of the housing opening, whereby said actuating movement of the cover directly both causes said pin means to be relatively driven into wall-puncturing abutment with said reservoir means and clears the housing opening for inflated expansion of the envelope means outwardly through said opening.

20. A portable flotation device in accordance with claim 19, wherein said dual function means further comprises gear means for directly transmitting said actuating movement of the cover into driven relative movement of said pin means for wall-puncturing abutment with said reservoir means.

21. A portable flotation device in accordance with claim 20, wherein said cover is hingedly connected to the housing for relative pivotal movement from said first to said second positions.

22. A portable flotation device in accordance with claim 19, wherein said dual function means causes said pin means to move, relative to said reservoir means, concurrently both toward said reservoir means along an axis and rotationally about said axis in response to said actuating movement of the cover.

23. A portable flotation device in accordance with claim 22, wherein said pin means comprises an axially elongated shaft carrying drill means at its end proximate said reservoir means for wall-puncturing abutment therewith.

24. A portable flotation device in accordance with claim 19, wherein said envelope means comprises a non-elastic envelope.

25. A portable flotation device in accordance with claim 19, further comprising one-way valve means between said reservoir means and said envelope means for preventing release of pressurized fluid from said envelope means.

26. A personal flotation assistance device securable to a user's body, comprising:

a housing securable to the body and having an opening;

reservoir means in said housing for containing a supply of pressurized fluid;

expandable envelope means in said housing in an initially collapsed condition and inflatable by receipt therein of fluid from said reservoir means;

pin means in said housing exteriorly of said expandable envelope means;

cover means mounted on said housing for user-manipulated relative movement from a first position closing said opening to a second position sufficiently remote from the opening to open said opening and enable inflating expansion therethrough of at least a portion of said envelope means from within said housing;

means for driving, in direct response to said movement of the cover means said first to said second position, said pin means into wall piercing abutment with said reservoir means thereby releasing the pressurized fluid from the reservoir means; and passage means for communicating fluid released from said reservoir means to said envelope means.

27. A personal flotation assistance device in accordance with claim 26, wherein said driving means causes said pin means to concurrently rotate about an axis and translate along said axis in response to said movement of the cover means from said first to said second position.

28. A personal flotation assistance device in accordance with claim 26, wherein said driving means comprises gear means connecting said cover means and said pin means.

29. A personal flotation assistance device in accordance with claim 26, wherein said cover means comprises a cover hinged to said housing for pivotal movement relative thereto between said first position closing the housing opening and said second position in which the cover is pivoted outwardly to a position sufficiently remote from said housing to enable expansion of said envelope means outwardly from the housing interior.

30. A personal flotation assistance device in accordance with claim 26, wherein said envelope means comprises a non-elastic envelope stored in said housing in an initially folded condition.

31. A personal flotation assistance device in accordance with claim 30, wherein said reservoir means contains a predetermined supply of pressurized fluid so that, when inflated by fluid released therefrom, said envelope means contains the fluid at substantially zero internal pressure.

32. A portable flotation assistance device securable to a user's body, comprising:

a housing securable to the body and having an open end;

a cover on said housing adapted for user-effected movement relative thereto between a first position closing said open end and a second position in which said housing end is substantially open;

reservoir means in said housing for containing a supply of pressurized fluid;

non-circular pin means in said housing;

means for translating and rotating said pin means relative to said reservoir means to cause said non-circular pin means to puncture said reservoir means and thereby release the pressurized fluid contained therein;

inflatable envelope means in said housing in an initially collapsed condition;

said non-circular pin means being disposed exteriorly of said inflatable envelope means; and passage means between said reservoir means and said envelope means for communicating the pressurized fluid therebetween so that, when the reservoir means is punctured by said non-circular pin means, the pressurized fluid released from the reservoir means is communicated to and inflates said envelope means, causing the initially collapsed envelope means to expand outwardly through said open housing end for providing flotation assistance to the user's body to which said housing is secured.

* * * * *